United States Patent [19]

Fagan

[11] 4,065,127

[45] Dec. 27, 1977

[54] GOLF CLUB GRIP ATTACHMENT

[76] Inventor: William J. Fagan, 715 Karen Lane, San Antonio, Tex. 78218

[21] Appl. No.: 702,283

[22] Filed: July 2, 1976

[51] Int. Cl.[2] ..... A63B 53/14

[52] U.S. Cl. ..... 273/81 D

[58] Field of Search ..... 273/75, 81 B, 81 D, 273/81.4–81.6, 165, 163 R, 163 A

[56] References Cited

U.S. PATENT DOCUMENTS

| | | | |
|---|---|---|---|
| 1,488,900 | 4/1924 | Armstrong | 273/163 R |
| 1,804,316 | 5/1931 | Butler | 273/165 |
| 2,481,778 | 9/1949 | Pearson | 273/165 |
| 2,484,762 | 10/1949 | Strazza | 273/165 |
| 3,529,826 | 9/1970 | Hulyk | 273/81 D X |
| 3,860,243 | 1/1975 | Prisco | 273/165 |

FOREIGN PATENT DOCUMENTS

| | | | |
|---|---|---|---|
| 6,763 | 4/1933 | Australia | 273/81 B |
| 9,232 of | 1913 | United Kingdom | 273/81.4 |
| 152,283 | 10/1920 | United Kingdom | 273/165 |
| 201,621 | 8/1923 | United Kingdom | 273/81 B |
| 17,802 of | 1913 | United Kingdom | 273/81 B |
| 137,448 | 1/1920 | United Kingdom | 273/81 B |

*Primary Examiner*—Richard J. Apley

*Attorney, Agent, or Firm*—Baldwin, Egan, Walling & Fetzer

[57] ABSTRACT

A grip attachment for use on a golf club in the form of an elongated strip that is securely attached to the hand grip portion of the club shaft as to extend longitudinally therealong, whereby a controlled and oriented placement of the hands in gripping the club shaft may be obtained to provide the golfer with a more secure grip of the club shaft and to enable the golfer to control the direction of the golf shot as well as to obtain greater distances.

1 Claim, 9 Drawing Figures

GOLF CLUB GRIP ATTACHMENT

BACKGROUND OF THE INVENTION

Heretofore various attachments have been provided for use on a golf club in an effort to enable the golfer to obtain better control of his use of the club.

U.S. Letters Patents Nos. 1,734,684; 2,481,778; 2,484,762 and 3,860,243 are patents directed to structures known to the present inventor of such prior art devices and which are directed to devices especially designed to aid the golfer in putting by an attempt to control the alignment and direction of the club face of the putter, and to devices operable to prevent the club shaft from rotating within the player's hands during use thereof.

Such prior art devices have been found to be inadequate to provide the unusual results that are obtained by the grip attachment of the present invention.

It is well known in the game of golf that a golfer must be able to have and maintain a firm grip of the club and wherein each hand of the player is particularly located and oriented on the club shaft with respect to the club head during the entire swing of the club in order to provide for proper direction to the golf ball as well as the distance of the golf shot. For example, should the player's hands be wrongfully placed on the club shaft with respect to the head of the club the golf ball may veer uncontrollably to the left or right of the intended direction of the shot.

Thus, the grip attachment of the present invention is especially designed to enable the golfer to properly place and orient each hand on the club shaft so as to control the direction of the flight of the golf ball.

Further, the grip attachment of the present invention provides a grip that feels more normal and secure to the hands of the golfer in gripping the golf club whereby he is able to obtain greater distances in his golf shot.

SUMMARY OF THE INVENTION

The grip attachment of the present invention comprises an elongated strip which is suitably attached to the hand grip portion or the shaft of the golf club, extending longitudinally therealong, and is provided with means to controllably locate and orient each hand of the player with respect to the club head and face to thereby permit the player to control both direction and distance of the golf shot.

Further, the grip attachment of the present invention is especially designed to enable it to be selectively located on the hand grip portion of the club shaft so as to accommodate the particular characteristics of the swing of the individual golfer.

Further objects and advantages of the grip attachment of the present invention will be apparent to one skilled in this art and upon reference to the accompanying drawings of a preferred embodiment thereof, and wherein:

Figure 2:
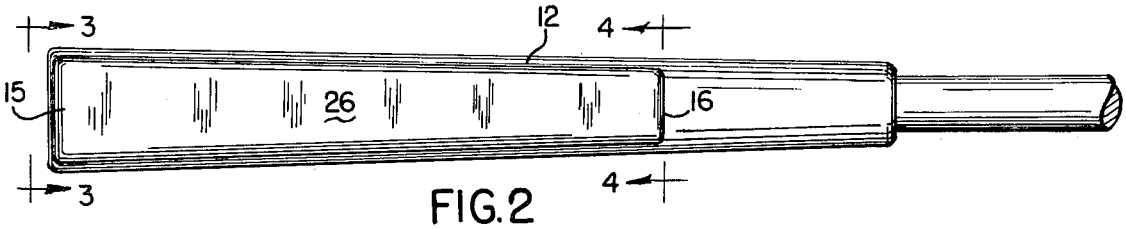
FIG. 2 is a top plan view of the grip attachment looking in the direction of the arrows 2—2 in FIG. 1.
Figure 4:
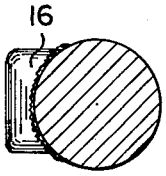
Figure 5:
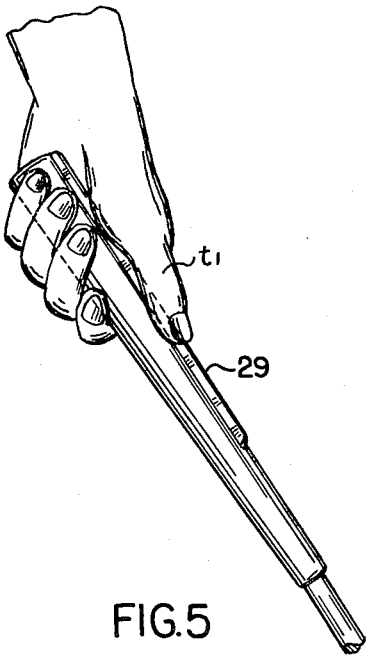
Figure 6:
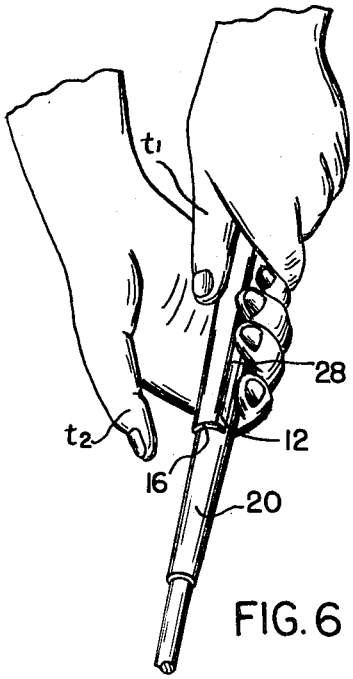
Figure 8:
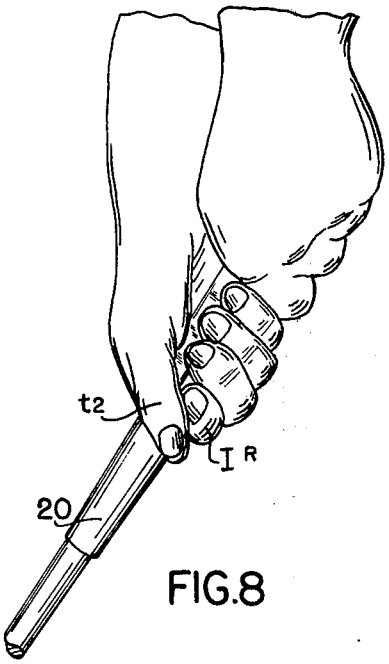
Figure 7:
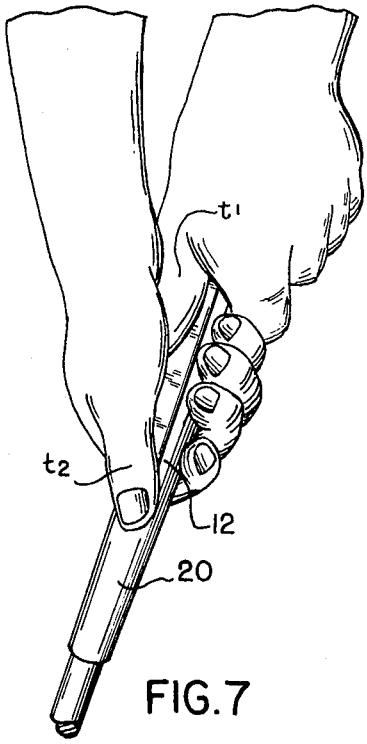
Figure 9:
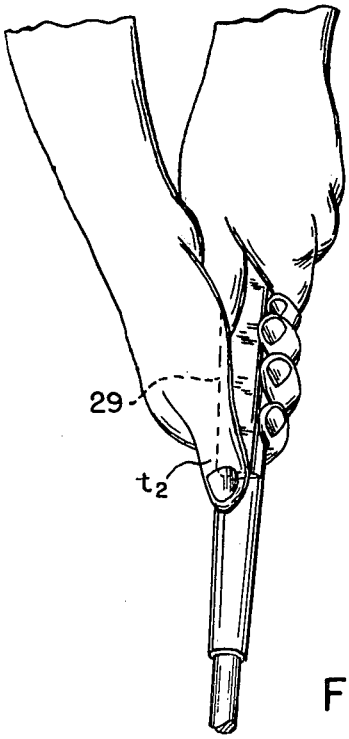

3—3 in FIG. 2 and illustrating the angular orientation of the grip attachment to the leading edge of the club face;

FIG. 4 is a sectional view taken on line 4—4 of FIG. 2;

FIG. 5 is a partial view of a golf club with the grip attachment of the present invention thereon, and illustrating the placement of one of the hands of the golfer on the club shaft, which in this instance, merely for illustration, is the left hand of a right-handed golfer;

FIG. 6 is a partial view of a golf club similar to FIG. 5 and illustrates the placement of a right-handed player's right hand onto the club shaft;

FIG. 7 is a partial view of a golf club having the grip attachment of the present invention thereon, and illustrates the grip and hand placement of the hands of a right-handed golfer for obtaining a straight shot in the intended direction;

FIG. 8 is a view similar to FIG. 7 but illustrating the grip and placement of the hands of a right-handed golfer for obtaining a hook-shot; and FIG. 9 is a view similar to FIG. 7 but illustrating the grip and placement of the hands of a right-handed golfer for obtaining a slice-type shot.

Referring now to the drawings, the grip attachment is illustrated in the configuration and placement on the golf club as it is used by a "right-hand" golfer. As will be understood in the art, and as will be more fully explained hereinafter, the grip attachment is also adapted for use by a "left-hand" golfer.

Figure 1:
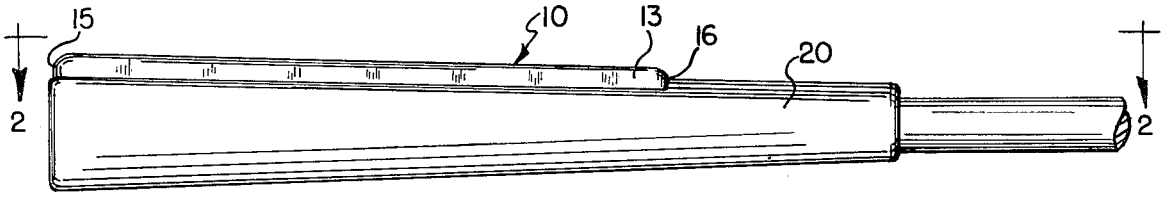
FIG. 1 is a side elevational view of the hand gripping portion of a golf club, and showing the grip attachment of the present invention placed in position thereon.

As best seen in FIGS. 1 and 2, the grip attachment of the present invention comprises, in its illustrated embodiment, an elongated body member identified in its entirety at 10, and which is generally an isosceles trapezoid in plan view, as best seen in FIG. 2, wherein opposed side walls 12 and 13 are of equal length, integrally connecting at one end with top end wall 15, and thence extending to the right as viewed in FIG. 2, projecting toward each other and connecting at the opposite ends thereof with lower end wall 16.

Figure 3:
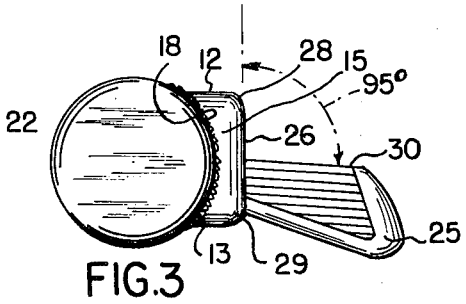
FIG. 3 is an end view of the golf club with the grip attachment thereon, looking in the direction of arrows

The body 10 is formed with a concave back surface 18, as seen in FIG. 3, which has a transverse curvature that corresponds to the perhipheral contour of the surface of the hand gripping portion 20 of the golf club.

As seen in FIG. 3 the grip attachment of the present invention, as illustrated, is attached to an "iron" but, as will be understood, said attachment is adapted to be used with any golf club, i.e., woods or irons, including the putter club.

As seen in FIG. 2, the diameter of the hand gripping portion 20 of the club is normally larger at its uppermost end or top of the club, as depicted at 22 in FIG. 3, and progressively decreases in diameter toward the club head 25. The body 10 is also formed with a generally flat front surface 26 which joins the opposed side walls 12 and 13 to form rounded corners 28 and 29 respectively, which project longitudinally along the body 10.

The elongate body 10 of the grip attachment as seen in FIG. 2 hence also conforms in its overall longitudinal configuration to the longitudinal contour of the club shaft so as to overlie approximately the same proportionate degree of surface area therealong.

The body 10 is intended to be securely attached to the grip portion 20 of the club, and for this purpose, a suitable adhesive may be applied to the concave back surface 18 which is sufficient to retain the said body in place, as illustrated on the upper end of the hand grip portion 20 of the club. As seen in FIGS. 1 and 2, the body 10 is placed upon the surface of the hand grip portion 20 with the top end wall 15 adjacent the top 22 of the club.

The body 10 is also located on the hand grip portion 20 so that the plane of the front surface 26 is at an angle of approximately 95° relative to the leading edge 30 of the club head 25, as is illustrated in FIG. 3.

The body 20 of the grip attachment extends longitudinally along the club shaft and is of sufficient length to accommodate thereon the placement of both hands of the golfer.

With the grip attachment mounted on the club shaft as illustrated, the golfer, either right or left-handed, may then utilize the same in the following manner to grip the club and to control the direction of the golf shot as well as to acquire greater distances of travel of the golf ball.

With reference now directed particularly to FIGS. 5–9, the grip attachment as illustrated therein is attached to a "right-hand" golf club, but as heretofore mentioned, it will become apparent how the present grip attachment may be similary applicable for use on the golf clubs of a "left-hand" golfer. For purposes of the present description and application of the grip attachment of the present invention to either a right or left-handed golfer, the "leading or forward" hand for a right-handed golfer will be considered the left hand, and the "trailing or rear" hand as the right hand. And, as will become apparent, the reverse is also true for a left-hand golfer.

As seen in FIG. 5, the "right-hand" golfer first placed his "leading" or left hand over the upper end of the grip portion 20 of the club such that the upper end of the body 10 of the grip attachment lies within the palm of the hand. The thumb $t_1$ is located alongside the side wall 13 of the body so as to extend along and to overlie the corner 29, with the remaining fingers of said hand being wrapped around said grip portion 20 and with the ends of the fingers adjacent the side wall 13 of said attachment, as shown. Thus the right-hand player uses the several parts of the body 10 of the grip attachment, i.e., particularly corner 29 and side wall 13, to align and locate his "leading" or left hand on the grip portion 20 of the club with respect to the club face 25. Next, the fingers of the trailing or right hand, as seen in FIG. 6, are placed on the grip portion 20 of the club below the left hand with the fingers thereof wrapping around said grip portion, and the ends of said fingers touching the side wall 12 of the body 10 of the grip attachment.

The thumb $t_2$ of the right hand, as seen in FIG. 7, is then placed upon and extended over the lower end wall 16 of the body 10. The grip portion 20 of the club is thereby also disposed within the palm of the right hand and the thumb $t_1$ of the left hand, as seen in FIG. 7, is also tucked into the right-hand palm. Thus, the right-hand player also uses the several parts of the body 10 of the grip attachment, i.e., particularly side wall 12 and lower end wall 16 to align and locate his "trailing" or right hand on the grip portion 20 of the club with respect to the club face 25.

It will now be obvious that a left-handed player may similarly grip the club using his right hand as the "leading" hand and his left hand as the "trailing" hand.

With this particular grip, as illustrated in FIG. 7, which is also similar to a baseball grip, the normal player should be able to hit the golf ball in a straight trajectory. Likewise, the golfer should be able to deliver maximum power to his swing and to obtain a greater distance to the flight of the ball by reason that the grip attachment provides a larger surface area for the hands to engage.

Should the golfer wish to change the trajectory of the flight of the ball, as for example to have the ball veer or hook to the left for a right-handed golfer, he may simply modify his grip to that as is illustrated in FIG. 8 wherein the thumb $t_2$ of the "trailing" hand is placed below the index finger $I_2$ of said "trailing" hand. With this grip being firmly maintained the golfer should be able to stroke the ball with the same swing, and the ball will hook or veer to the left.

Conversely, should the golfer desire to slice or fade the ball, as for example to the right for a right-handed golfer, he may simply modify his grip to that as is illustrated in FIG. 9 where the thumb "trailing" hand is located along the corner 29. With this grip firmly maintained, the golfer should be able to have the ball slice or fade to the right.

And, for a left-handed golfer, it is now apparent that a similar grip adjustment may be undertaken by a left-hand golfer as to the positioning of his "leading" and "trailing" hands to provide a corresponding hook or slice shot.

A grip attachment of the type herein described may be constructed from a suitable material such as plastic, vinyl, leather, rubber, wood, etc., which is sufficiently pliable to conform to the contour of the grip portion 20 of the club.

The grip attachment may be provided with any suitable adhesive material on its concave surface 18 which may be protected by any suitable removable covering, such as paper or the like, that is peeled away prior to the grip attachment being placed onto the grip portion 20 of the club.

A grip attachment of the type described herein and manufactured by the inventor has an overall length of approximately 7¼ inches from end wall 22 to the end wall 16; a width at the upper end wall 22 of approximately inch; a width at the opposite end wall 16 of approximately ½ inch; a central thickness of approximately ⅛ inch; and an overall depth of approximately ¼ inch.

Having thus described one embodiment of grip attachment of the present invention, it is apparent that the same may partake of modifications and variations in configuration without departing from the inventive concept hereof as is defined in the claims.

What is claimed is:

1. In combination a golf club having a hand grip portion on the upper end of the shaft of the club and a head portion on its opposite end and a non-wrapped, exposed grip attachment secured thereto, said grip attachment comprising an elongate body attached to the surface of the grip portion and extending longitudinally therealong, said body being in the form of an isosceles trapezoid in plan and symmetrical on its opposite longitudinally extending sides and having a flat front surface extending along the length of said body, alignment means formed on said body to accommodate the placement of both hands of the player thereon comprising side walls formed on the longitudinally extending sides of said body, rounded corner portions connecting between the adjoining edges of said side walls and said flat front surface, a bottom end wall defining the lowermost transverse edge of said body and which is spaced upwardly on said grip portion from the lower end thereof, said flat front surface of said body being disposed at an angle of approximately 95° with respect to the leading edge of the head of the club, whereby said alignment means is gripped by both hands of the player such that the side walls and corner portions of the body are oriented in preselected position with respect to the fingers of the player's hand and the thumb of the lower hand is disposed over the bottom wall of said body in predetermined position thereon, said grip being thus effective to regulate the orbit of swing of the hands of the player as he swings the golf club and the consequent direction of flight and distance traveled by the golf ball upon being struck by the golf club.

* * * * *